US009131740B2

(12) United States Patent
Renaud

(10) Patent No.: US 9,131,740 B2
(45) Date of Patent: Sep. 15, 2015

(54) PENCIL SUPPORT FOR CONSTRUCTION HELMET

(75) Inventor: Benoît Renaud, Montreal (CA)

(73) Assignee: COMMUNICATIONS ART SOLUTIONS INC., Montreal (CA)

( * ) Notice: Subject to any disclaimer, the term of this patent is extended or adjusted under 35 U.S.C. 154(b) by 99 days.

(21) Appl. No.: 13/983,395

(22) PCT Filed: Jan. 31, 2012

(86) PCT No.: PCT/CA2012/050054

§ 371 (c)(1),
(2), (4) Date: Oct. 24, 2013

(87) PCT Pub. No.: WO2012/103647

PCT Pub. Date: Aug. 9, 2012

(65) Prior Publication Data

US 2014/0033407 A1 Feb. 6, 2014

(30) Foreign Application Priority Data

Feb. 3, 2011 (CA) ..... 2730705

(51) Int. Cl.
*A42B 3/04* (2006.01)
*B43K 23/00* (2006.01)

(52) U.S. Cl.
CPC ..... *A42B 3/0406* (2013.01); *A42B 3/04* (2013.01); *B43K 23/001* (2013.01)

(58) Field of Classification Search
CPC ..... B43K 23/001; B43K 23/00; B43K 25/00; B43K 25/02; B43K 25/024; A45F 5/02; A42B 3/04; A42B 3/0406; A42B 1/24; F16M 13/02
USPC ..... 2/422, 209.13; 24/10 R, 11 R, 11 FE, 24/11 PP, 11 HC, 11 M, 11 S, 3.12; 248/316.7; D3/215, 229; D19/83
See application file for complete search history.

(56) References Cited

U.S. PATENT DOCUMENTS

| | | | | | |
|---|---|---|---|---|---|
| 1,454,034 | A | * | 5/1923 | Barnstable | 2/422 |
| 1,466,737 | A | * | 9/1923 | Kreeger | 24/11 FE |
| 2,670,512 | A | * | 3/1954 | Flora | 24/289 |
| 3,182,368 | A | * | 5/1965 | Fair | 24/347 |
| 3,521,332 | A | * | 7/1970 | Kramer | 403/188 |
| 3,983,602 | A | * | 10/1976 | Barry | 24/11 R |
| 4,475,676 | A | * | 10/1984 | Smith | 224/247 |

(Continued)

FOREIGN PATENT DOCUMENTS

| | | |
|---|---|---|
| CA | 2026259 A1 | 3/1992 |
| CA | 2185700 A1 | 10/1995 |

(Continued)

*Primary Examiner* — Amy Vanatta
(74) *Attorney, Agent, or Firm* — Norton Rose Fulbright Canada LLP

(57) ABSTRACT

A pencil support for construction helmet, the construction helmet being of the type having a slot in the bottom of its lateral side, the slot having an elongated shape. The pencil support comprises a support portion with a back plate and a tongue forming concurrently a receptacle to accommodate a writing instrument. An anchoring portion has a pair of legs projecting downwardly from a bottom of the support portion. One or both at of the legs has a projecting foot at a bottom, and a wedge projecting in an opposite direction above a level of the foot, and a space between the legs being entirely free.

10 Claims, 4 Drawing Sheets

(56) References Cited

U.S. PATENT DOCUMENTS

| | | | | | |
|---|---|---|---|---|---|
| 5,066,154 | A | * | 11/1991 | Renaud | 401/131 |
| 5,640,742 | A | * | 6/1997 | White et al. | 24/3.12 |
| 5,788,197 | A | * | 8/1998 | Tutela | 248/156 |
| 5,829,103 | A | * | 11/1998 | Allen | 24/11 R |
| 5,867,874 | A | * | 2/1999 | Simpson | 24/336 |
| D412,611 | S | * | 8/1999 | Simpson | D2/891 |
| 6,290,112 | B1 | * | 9/2001 | Iver | 224/271 |
| 6,481,060 | B1 | * | 11/2002 | Tsai | 24/3.12 |
| D477,029 | S | * | 7/2003 | Korowitz | D19/78 |
| D478,630 | S | * | 8/2003 | Riggins | D19/83 |
| 6,616,294 | B1 | | 9/2003 | Henry | |
| 7,866,813 | B2 | * | 1/2011 | Anhalt | 351/155 |

FOREIGN PATENT DOCUMENTS

| | | | |
|---|---|---|---|
| CA | 2717621 | A1 | 4/2011 |
| GB | 2319948 | A | 6/1998 |

* cited by examiner

PENCIL SUPPORT FOR CONSTRUCTION HELMET

CROSS-REFERENCE TO RELATED APPLICATION

The present patent application claims priority on Canadian Patent Application No. 2,730,705, filed on Feb. 3, 2011, and incorporated herein by reference.

FIELD OF THE APPLICATION

The present disclosure pertains to a pencil support of the type used to support a pencil or like writing instrument on a construction helmet.

BACKGROUND OF THE ART

Construction helmets, also known as security hats, safety helmets, hard hats, etc., are commonly used on construction sites to protect the wearer from the impact of falling objects. Slots are present on some of the existing constructions helmets (i.e., slotted construction helmets) and are at a bottom of sides of the security hats, for instance to support ear muffs or a face shield.

Oftentimes, workers on construction sites need to have a pencil or other writing instrument at hand. Accordingly, pencil supports have been created to use the slots of construction helmets (i.e., slotted security hats) to support pencils. In such cases, the pencil is at hand at all times. In other cases, the pencil supports are used to support other elongated items, such as a ruler.

However, considering the various types of construction helmets on the market, there is not one pencil support that can be used universally. For example, there are different slot shapes and sizes, and the existing anchoring portions of pencil supports have various configurations to efficiently connect to slots. Moreover, pencil supports must be stable on the safety hat to be practical, whatever the slot shape or size.

SUMMARY OF THE APPLICATION

It is therefore an aim of the present disclosure to provide a novel pencil support for construction helmets.

It is a further aim of the present disclosure for the pencil support to have a configuration allowing same to be used with different slot shapes and sizes.

Therefore, in accordance with the present application, there is provided a pencil support for construction helmet, the construction helmet being of the type having a slot in the bottom of its lateral side, the slot having an elongated shape, the pencil support comprising: a support portion with a back plate and a tongue forming concurrently a receptacle to accommodate a writing instrument; and an anchoring portion having a pair of legs projecting downwardly from a bottom of the support portion, the legs each having a projecting foot at a bottom, and a wedge projecting in an opposite direction above a level of the foot, and a space between the legs being entirely free.

Further in accordance with the present disclosure, an abutment is above each said wedge to abut against a periphery of the slot when the pencil support is inserted in the slot.

Still further in accordance with the present disclosure, the abutments are merged to a top of the wedge.

Still further in accordance with the present disclosure, the legs are interconnected by a beam in the anchoring portion to define an inverted U-shape.

Still further in accordance with the present disclosure, a reinforcement beam projects outwardly from the beam and contacting the tongue for strengthening the tongue.

Still further in accordance with the present disclosure, the back plate has a generally rectangular outline and is curved to marry the shape of the helmet.

Still further in accordance with the present disclosure, a cutout is defined in the back plate, the cutout being in register with the tongue.

Still further in accordance with the present disclosure, the support portion and the anchoring portion are integrally made of a polymeric material.

Still further in accordance with the present disclosure, a set of the foot and the wedge is provided for each said leg.

Still further in accordance with the present disclosure, the tongue has a curved shape.

Still further in accordance with the present disclosure, the top edge forms a throat portion with the back plate.

Still further in accordance with the present disclosure, the foot projects inward of the helmet and the wedge projects outward of the helmet.

Still further in accordance with the present disclosure, the wedge tapers from top to bottom.

DESCRIPTION OF PREFERRED EMBODIMENTS

Figure 1:
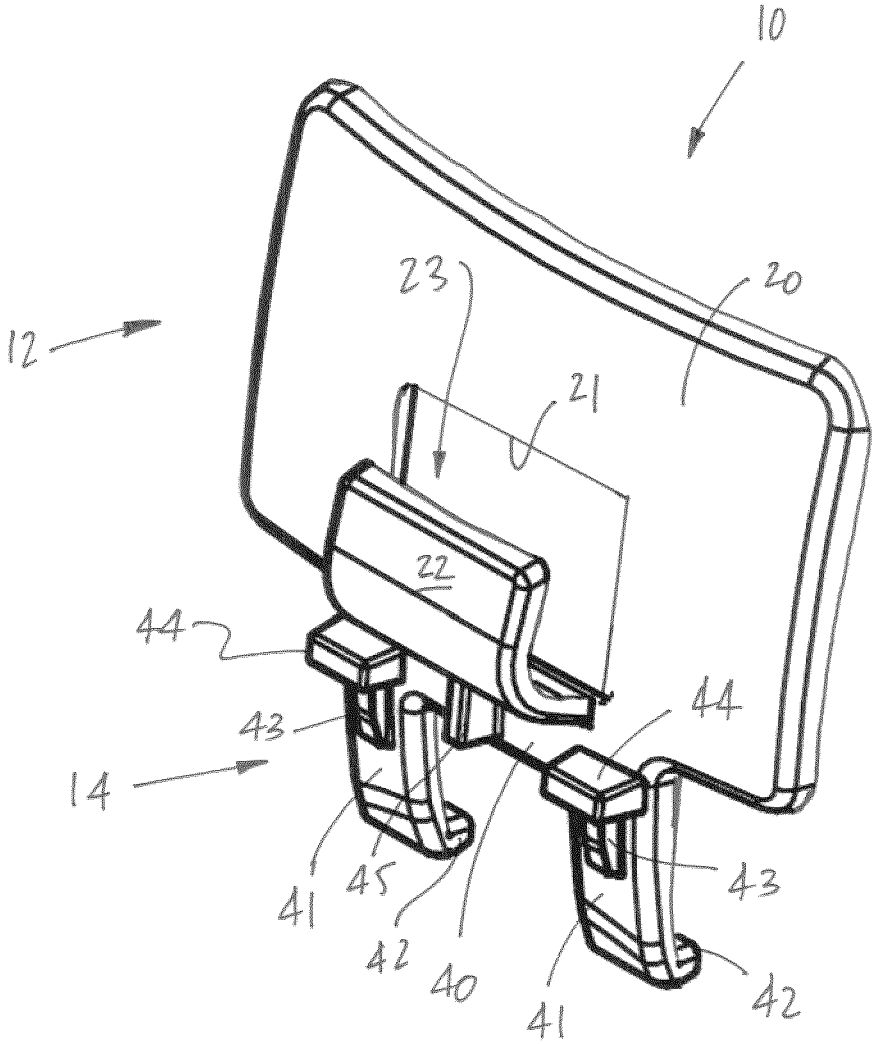
FIG. 1 is an outer perspective view of a pencil support for a construction helmet in accordance with a first embodiment of the present disclosure.
Figure 2:
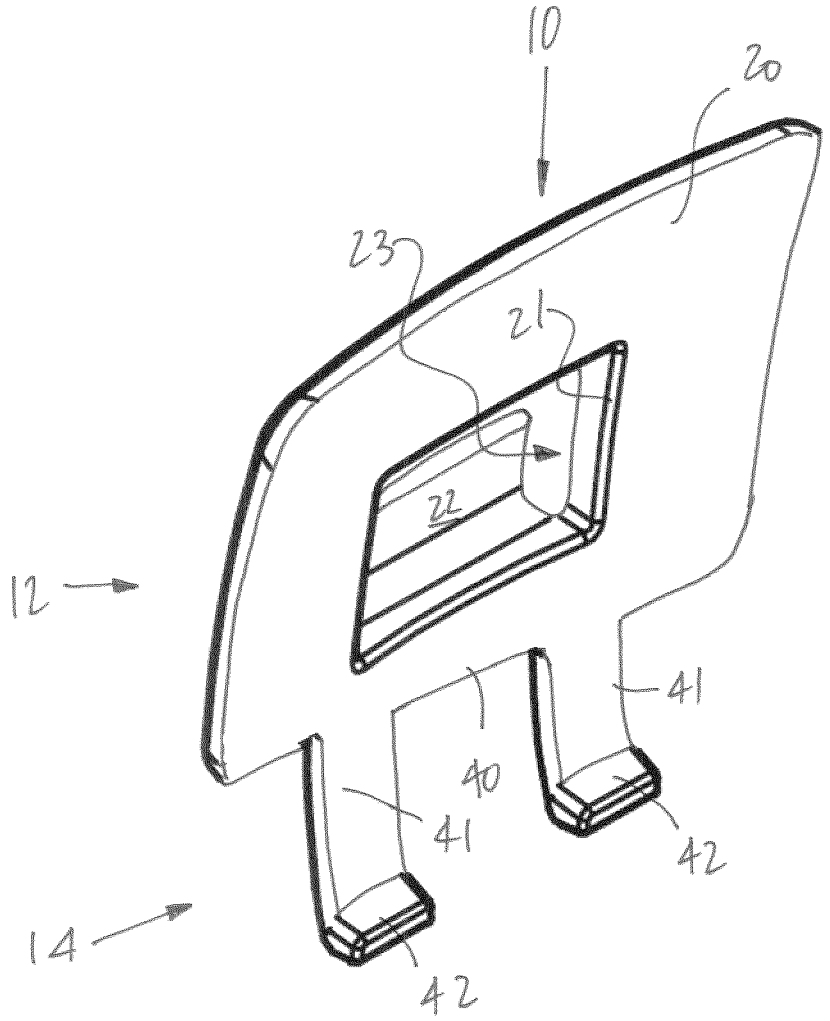
FIG. 2 is an inner perspective view of the pencil support of FIG. 1.

Referring to the drawings and more particularly to FIGS. 1 and 2, there is illustrated a pencil support for construction helmet at 10. The expression construction helmet is used hereinafter, but refers to a security hat, safety helmet, a hard hat or any other name that could be used therefor. For simplicity purposes, the expression pencil is used hereinafter, but the support 10 may be used with pens, carpenter pencils, chalk markers, or any other writing instruments. Moreover, some other accessories could be used and supported by the support 10, which items typically have a slender elongated portion, such as a ruler.

The pencil support 10 has a support portion 12 that is the interface between the pencil support 10 and the pencil. The pencil support 10 also has an anchoring portion 14 that is the interface between the pencil support 10 and the construction helmet.

The support portion 12 has a back plate 20. The back plate 20 is typically slightly curved enabling it to rest against the surface of the construction helmet. For this purpose, a pre-applied adhesive may be provided on an inner surface of the back plate 20, for instance with a peel-off substrate. The back plate 20 has a generally rectangular outline, but may have any other appropriate shape, such as an ornamental shape. The exposed outer surface of the back plate 20, seen in FIG. 1, may be used to expose some information, such as marketing data, a brand name, a mark, instructions, ornamentation.

A cutout 21 is defined in the back plate 20. The cutout 21 is shown having a rectangular shape but could have any other appropriate shapes. A curved tongue 22 projects upwardly from a bottom edge of the cutout 21. A free end of the curved tongue 22 is cantilevered with respect to the back plate 20, and is sized so as to form a throat with the back plate 20, thereby defining a receptacle 23 for a pencil or like object to be held captive therein. The receptacle 23 typically has a curved hook shape by way of the curved tongue 22. For this purpose, the pencil support 10 is typically made of a plastic material that has a level of elasticity enabling the curved tongue 22 to deform to allow a pencil to be held releasably captive therein.

The anchoring portion 14 has an inverted U-shape by the presence of a beam 40 and legs 41 at opposite ends of the beam 40. The inverted U-shape of the anchoring portion 14 appropriately has a clearance between the legs 41, which clearance may accommodate any tab that projects in some types of helmet slots when the legs 41 are inserted in the slot. The space between the legs 41 is entirely free at least up to the height of the wedges 43.

Figure 3:
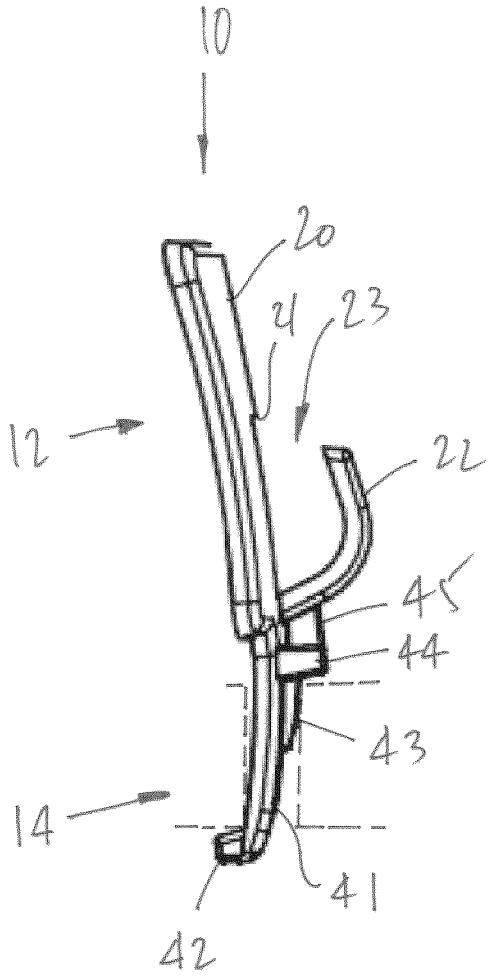
FIG. 3 is a front elevation view of the pencil support of FIG. 1, as shown relative to a construction helmet.
Figure 4:
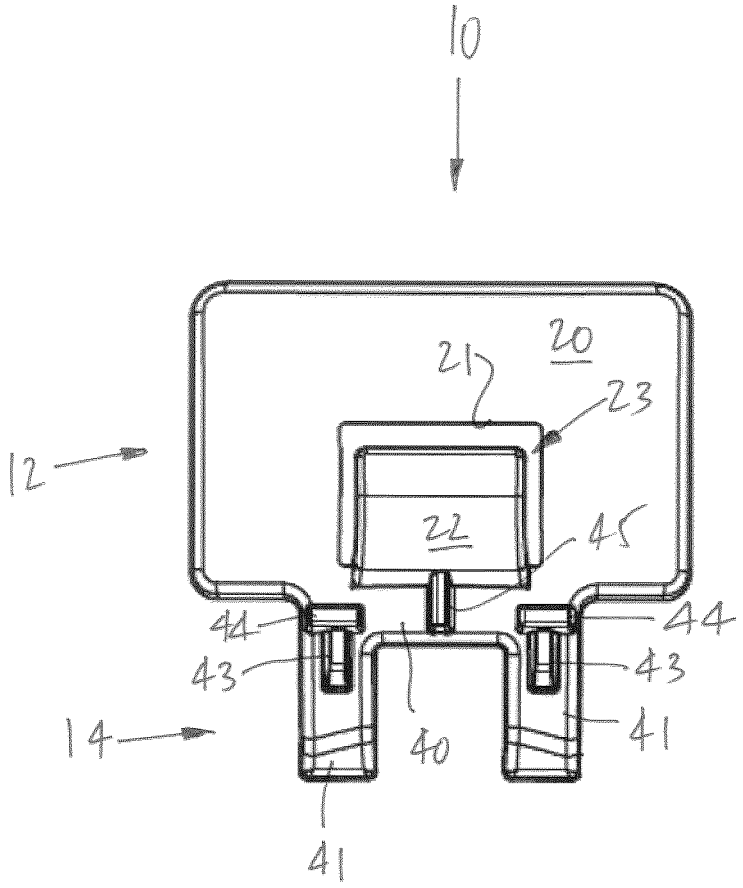
FIG. 4 is a side elevation view of the pencil support of FIG. 1.

Accordingly, the anchoring portion 14 relies on the legs 41 to retain the pencil support 10 to the helmet. The legs 41 are inserted in a slot of a construction helmet, and feet 42 at a bottom of the legs 41 grip onto a bottom edge of the helmet, through the slot, as shown in FIG. 3. Accordingly, the legs 41 are trapped in the slot by the feet 42 caught against the bottom edge.

Wedges 43 are provided on outer surfaces of the legs 41 and taper from top to bottom. The wedges 43 may alternatively be on inner surfaces of the legs 41, but are on the opposite sides of the feet 42. Accordingly, the wedges 43 contact a periphery of the slot when inserted thereon, thereby leveraging the feet 42 forward. As a result, when the feet 42 move below a bottom edge of a wall of the helmet, the feet 42 move forward into abutting engagement with the bottom edge as leveraged forward by the action of the wedges 43.

Abutments 44 are provided at a top of the wedges 43, and may integral therewith. The abutments 44 may ultimately abut against a top surface of a periphery of the slot to stabilize the pencil support 10 with respect to the periphery of the slot. In order to reinforce the curved tongue 22, a reinforcement beam 45 may be provided as projecting outwardly from the beam 40. More than one reinforcement beam 45 may be used.

When the pencil support 10 is inserted in a slot of a construction helmet, the legs 41 are entered into the slot. The distance between foremost and rearmost edges of the legs 41 is selected as a function of the slot size of available helmets. More specifically, the distance between these edges of the legs 41 is less than the size of the smallest slot of commercially available hats.

When inserting the legs 41 into the slot, the feet 42 will ultimately extend below a bottom edge of the helmet in which case the legs 41 will push the feet 42 under the bottom edge of the helmet by the leveraging action of the wedges 43. The support 10 is fully inserted when the abutments 44 come into contact with a surface adjacent to the periphery of the slot. At that point, a pencil may be inserted in the receptacle 23 and is held captive therein. The pencil may deform slightly and bend into the cutout 21 by the pressing action of the tongue 22.

The combination of the feet 42 and wedge 43 allows the legs 41 to perform the clamping of the pencil support 10 to the helmet through the slot. The abutments 44 insure that the pencil support 10 is held stable in the helmet.

The invention claimed is:

1. A pencil support for a construction helmet, the construction helmet being of the type having a slot in the bottom of its lateral side, the slot having an elongated shape, the pencil support comprising:

an integral single body of polymeric material having:

a support portion with a back plate and a tongue forming concurrently a receptacle to accommodate a writing instrument; and an anchoring portion having an inverted U-shape, the inverted U-shape having a pair of legs projecting downwardly from a beam at a bottom of the support portion, the legs each having a front continuous surface, a rear continuous surface, a foot projecting rearwardly from the rear continuous surface at a bottom of said leg, and a wedge projecting forwardly from the front continuous surface in an opposite direction than the foot and being above a level of the foot, a space being bound by opposite facing edges of the legs being entirely free to define the inverted U-shape.

2. The pencil support according to claim 1, further comprising an abutment above each said wedge to abut against a periphery of the slot when the pencil support is inserted in the slot.

3. The pencil support according to claim 2, wherein the abutments are directly connected to a top of the wedge.

4. The pencil support according to claim 1, further comprising a reinforcement beam projecting outwardly from the beam and contacting the tongue for strengthening the tongue.

5. The pencil support according to claim 1, wherein the back plate has a generally rectangular outline and is curved to marry the shape of the helmet.

6. The pencil support according to claim 1, comprising a cutout in the back plate, the cutout being in register with the tongue.

7. The pencil support according to claim 1, wherein the tongue has a curved shape.

8. The pencil support according to claim 1, wherein a top edge of the tongue forms a throat portion with the back plate.

9. The pencil support according to claim 1, wherein the foot projects inward of the helmet and the wedge projects outward of the helmet.

10. The pencil support according to claim 1, wherein the wedge tapers from top to bottom.

* * * * *